US010180642B2

(12) United States Patent
Oikawa et al.

(10) Patent No.: US 10,180,642 B2
(45) Date of Patent: Jan. 15, 2019

(54) PRESSURE DEVICE, IMAGE FORMING APPARATUS, AND METHOD OF CONTROLLING PRESSURE DEVICE

(71) Applicants: Ken Oikawa, Kanagawa (JP); Minoru Takahashi, Kanagawa (JP)

(72) Inventors: Ken Oikawa, Kanagawa (JP); Minoru Takahashi, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/543,616

(22) PCT Filed: Jan. 20, 2016

(86) PCT No.: PCT/JP2016/000280
§ 371 (c)(1),
(2) Date: Jul. 14, 2017

(87) PCT Pub. No.: WO2016/117339
PCT Pub. Date: Jul. 28, 2016

(65) Prior Publication Data

US 2018/0004131 A1 Jan. 4, 2018

(30) Foreign Application Priority Data

Jan. 20, 2015 (JP) ..... 2015-008545
Dec. 10, 2015 (JP) ..... 2015-241404

(51) Int. Cl.
*G03G 15/16* (2006.01)
*G03G 15/00* (2006.01)
(Continued)

(52) U.S. Cl.
CPC ..... *G03G 15/167* (2013.01); *G03G 15/2032* (2013.01); *G03G 15/2064* (2013.01); *G03G 15/22* (2013.01); *G03G 15/5062* (2013.01)

(58) Field of Classification Search
CPC ..... G03G 15/167; G03G 15/2032; G03G 15/2064; G03G 15/2067; G03G 15/0136
See application file for complete search history.

(56) References Cited

U.S. PATENT DOCUMENTS 5,318,631 A * 6/1994 Tsukamoto ..... G03G 15/167 118/231
6,381,423 B1 4/2002 Eom
(Continued)

FOREIGN PATENT DOCUMENTS

EP 2211239 A2 7/2010
JP 58-221877 12/1983
(Continued)

OTHER PUBLICATIONS

Extended European Search Report dated Dec. 8, 2017.
(Continued)

*Primary Examiner* — Sandra Brase
(74) *Attorney, Agent, or Firm* — Harness, Dickey & Pierce, P.L.C.

(57) ABSTRACT

A pressure device applies pressure to a sheet medium on part of a surface of which an image bearer is formed. The pressure device includes: a driving unit that changes a distance between a first pressing unit and a second pressing unit; a control unit that controls the driving unit such that the distance between the first pressing unit and the second pressing unit becomes a set target value; and a target setting unit that sets the target value to a first distance that is larger than a thickness of the sheet medium when the sheet medium is not present between the first pressing unit and the second pressing unit, and sets the target value to a second distance for applying a target pressure to the sheet medium when the sheet medium and the image bearer are present between the first pressing unit and the second pressing unit.

17 Claims, 13 Drawing Sheets

(51) Int. Cl.
*G03G 15/20* (2006.01)
*G03G 15/22* (2006.01)

(56) References Cited

U.S. PATENT DOCUMENTS

| | | | | |
|---|---|---|---|---|
| 2008/0031647 | A1* | 2/2008 | Yoshikawa | G03G 15/2032 399/67 |
| 2009/0234498 | A1 | 9/2009 | Takahashi et al. | |
| 2010/0034565 | A1 | 2/2010 | Ashikawa et al. | |
| 2010/0142985 | A1 | 6/2010 | Minbe et al. | |
| 2010/0239282 | A1 | 9/2010 | Ashikawa et al. | |
| 2011/0135324 | A1 | 6/2011 | Peng et al. | |
| 2011/0222881 | A1* | 9/2011 | Yamada | G03G 15/2032 399/45 |
| 2012/0121293 | A1 | 5/2012 | Mimbu et al. | |
| 2012/0326387 | A1 | 12/2012 | Ishizaki et al. | |
| 2013/0051824 | A1* | 2/2013 | Bobo | G03G 15/2032 399/45 |
| 2013/0121715 | A1 | 5/2013 | Ashikawa et al. | |
| 2013/0134665 | A1 | 5/2013 | Asano et al. | |
| 2013/0161900 | A1 | 6/2013 | Takahashi et al. | |
| 2013/0223901 | A1 | 8/2013 | Minbe et al. | |
| 2014/0072340 | A1* | 3/2014 | Kato | G03G 15/1605 399/121 |
| 2017/0052483 | A1 | 2/2017 | Takahashi et al. | |

FOREIGN PATENT DOCUMENTS

| | | |
|---|---|---|
| JP | 05-289569 | 11/1993 |
| JP | 06-274051 | 9/1994 |
| JP | 2001-264192 | 9/2001 |
| JP | 2008-070818 | 3/2008 |
| JP | 2009-276383 | 11/2009 |
| JP | 2010-151983 | 7/2010 |
| JP | 2016-001299 | 1/2016 |

OTHER PUBLICATIONS

International Search Report PCT/JP2016/000280 dated Apr. 12, 2016.
Written Opinion PCT/JP2016/000280 dated Apr. 12, 2016.

* cited by examiner

PRESSURE DEVICE, IMAGE FORMING APPARATUS, AND METHOD OF CONTROLLING PRESSURE DEVICE

CROSS-REFERENCE TO RELATED APPLICATIONS

This application is the national phase under 35 U.S.C. § 371 of PCT International Application No. PCT/JP2016/000280 which has an International filing date of Jan. 20, 2016, which designated the United States of America and which claims priority to Japanese patent application number JP 2015-008545 filed Jan. 20, 2015 and Japanese patent application number JP 2015-241404 filed Dec. 10, 2015, the entire contents of which are hereby incorporated herein by reference.

TECHNICAL FIELD

The present invention relates to a pressure device, an image forming apparatus, and a method of controlling a pressure device.

BACKGROUND ART

An electrophotographic type image forming apparatus forms an electrostatic latent image on a photoconductor by optical writing, and develops the electrostatic latent image to obtain a toner image. When the toner image is transferred onto a sheet and fixed onto the sheet with heat or pressure, an image is formed on the sheet.

Known is a technique in which, in a full-color image forming apparatus, a toner image is transferred onto an intermediate transfer body, and the transferred toner image is transferred onto the sheet from the intermediate transfer body. For example, a color toner image is temporarily transferred (primary transfer) onto the intermediate transfer body such as an intermediate transfer belt and an intermediate transfer drum. After color toner images of a plurality of colors are superimposed on the intermediate transfer body, the color toner images are transferred (secondary transfer) onto the sheet from the intermediate transfer body. Thereafter, the color toner images are fixed onto the sheet, and a full-color image is obtained.

SUMMARY OF INVENTION

Technical Problem

When speed fluctuation of the intermediate transfer body is caused in such an image forming apparatus including the intermediate transfer body, superimposing positions of the color toner images in transferring are deviated from each other. The deviation in the superimposing positions of the color toner images may cause color irregularity and a streak image, and image quality may be deteriorated.

The speed fluctuation of the intermediate transfer body may be caused, for example, when the sheet enters a nip between a roller and the intermediate transfer body at which the secondary transfer is performed. For example, when the sheet enters the nip, a load on the roller is increased and a conveying speed of the intermediate transfer body is temporarily reduced. That is, speed fluctuation of the intermediate transfer body is caused. Also when the sheet leaves the nip, the conveying speed is temporarily reduced, and the speed fluctuation of the intermediate transfer body is caused likewise.

An impact force caused when the sheet enters the nip is unsteady and transitional, and has a broad frequency characteristic. It is difficult to effectively suppress the speed fluctuation of the intermediate transfer body caused by disturbance of such a broad frequency characteristic by controlling the intermediate transfer body.

For example, Patent Literature 1 discloses a technique of keeping a low pressure before a medium enters a fixing nip, and increasing the pressure after the medium has entered the fixing nip. However, with the technique disclosed in Patent Literature 1, a pressure is applied to the fixing nip when the medium enters the fixing nip, so that the impact force caused when the sheet enters the nip cannot be completely suppressed.

Patent Literature 2 discloses a technique of moving a position of a secondary transfer roller in accordance with a sheet size or a sheet thickness, and statically adjusting a transfer pressure generated in the nip. However, with the technique disclosed in Patent Literature 2, a larger pressure is applied to the nip as the thickness of the medium increases, so that the impact force is large when a thick sheet enters the nip even if the impact force is reduced when a thin sheet enters the nip.

Patent Literature 3 discloses a technique of arranging a piezoelectric element in a fixing unit, and adjusting a pressing force based on a pressure detection result obtained by the piezoelectric element. However, with the technique disclosed in Patent Literature 3, cost of the piezoelectric element for measuring the pressing force is extremely high, and reliability and durability are reduced when the apparatus is used under high temperature and high pressure.

In view of the above, there is a need to provide a pressure device, an image forming apparatus, and a method of controlling the pressure device that can eliminate an impact caused when a sheet medium enters between a first pressing unit and a second pressing unit in a case in which a predetermined pressure is applied to the sheet medium by the first pressing unit and the second pressing unit.

Solution to Problem

A pressure device is configured to apply pressure to a sheet medium on part of a surface of which an image bearer is formed. The pressure device includes: a first pressing unit and a second pressing unit that are arranged to be able to approach to and separate from each other, and configured to send out the sheet medium while applying pressure to the sheet medium by at least one of the first pressing unit and the second pressing unit rotating in a state in which the first pressing unit and the second pressing unit hold the sheet medium; a driving unit configured to change a distance between the first pressing unit and the second pressing unit; a distance detection unit configured to detect the distance between the first pressing unit and the second pressing unit; a control unit configured to control the driving unit such that the distance between the first pressing unit and the second pressing unit becomes a set target value; and a target setting unit configured to set the target value. The target setting unit sets the target value to a first distance that is larger than a thickness of the sheet medium when the sheet medium is not present between the first pressing unit and the second pressing unit, and sets the target value to a second distance for applying a target pressure to the sheet medium when the sheet medium and the image bearer are present between the first pressing unit and the second pressing unit.

Advantageous Effects of Invention

According to the present invention, in a case in which a predetermined pressure is applied to a sheet medium by a first pressing unit and a second pressing unit, an impact caused when the sheet medium enters between the first pressing unit and the second pressing unit can be eliminated.

DESCRIPTION OF EMBODIMENTS

The following describes embodiments of the present invention in detail with reference to the attached drawings.

First Embodiment

Figure 1:
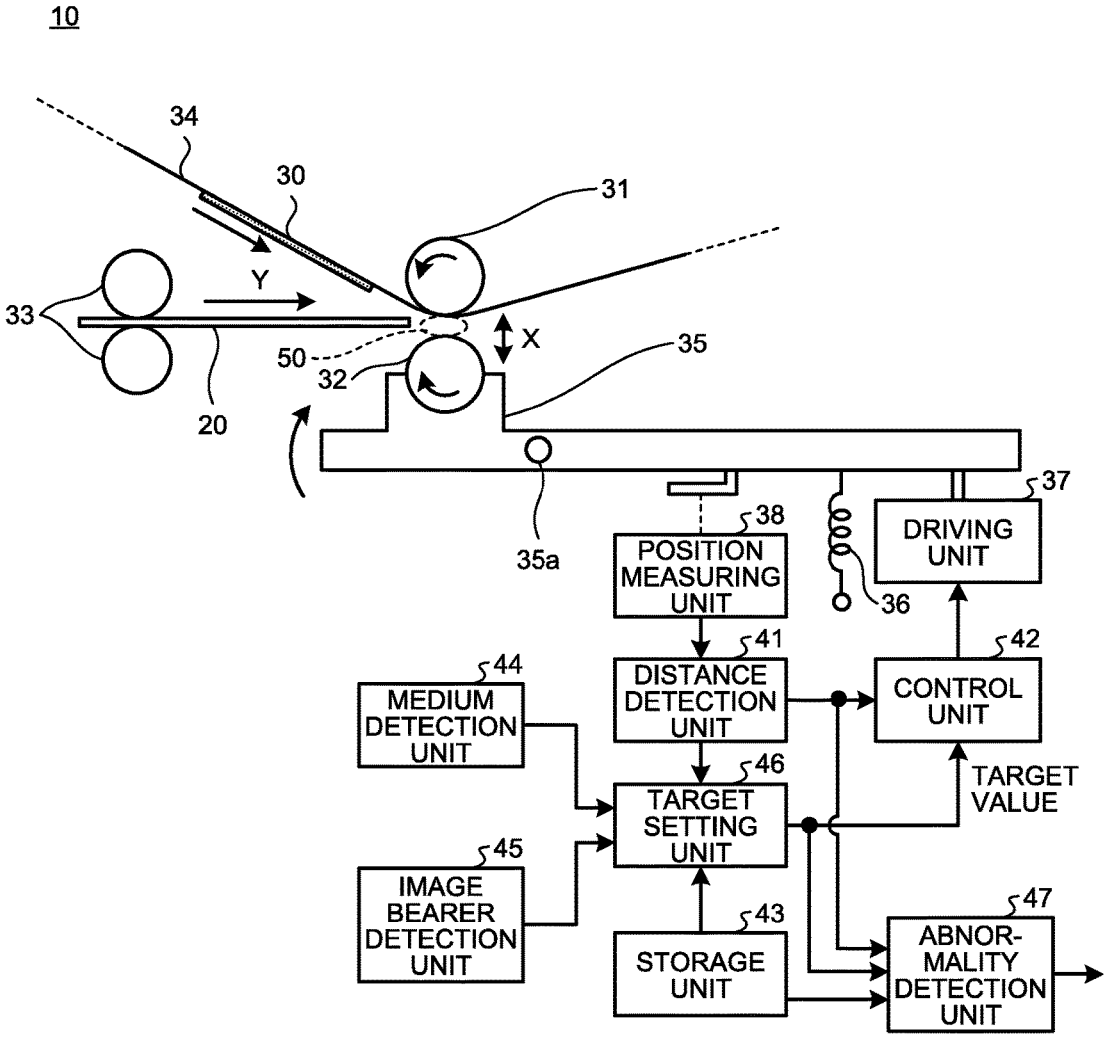
FIG. 1 is a diagram illustrating a configuration of a pressure device according to a first embodiment.

FIG. 1 is a diagram illustrating a configuration of a pressure device 10 according to a first embodiment. The pressure device 10 according to the first embodiment applies pressure to a sheet medium 20 to which an image bearer 30 being a thin film adheres on part of the surface thereof. The pressure device 10 according to the present embodiment is applied, for example, to a transfer unit that performs secondary transfer in an electrophotographic type image forming apparatus.

The pressure device 10 includes a first pressing unit 31, a second pressing unit 32, a conveying unit 33, a transfer belt 34, a supporting unit 35, an elastic part 36, a driving unit 37, a position measuring unit 38, a distance detection unit 41, a control unit 42, a storage unit 43, a medium detection unit 44, an image bearer detection unit 45, a target setting unit 46, and an abnormality detection unit 47.

At least one of the first pressing unit 31 and the second pressing unit 32 is cylindrical. In this example, both of the first pressing unit 31 and the second pressing unit 32 are cylindrical. The first pressing unit 31 and the second pressing unit 32 are arranged such that center axes thereof are parallel with each other.

The first pressing unit 31 and the second pressing unit 32 are arranged such that they can approach to and separate from each other. When they approach to each other, side surfaces thereof are brought into contact with each other, and when they separate from each other, a gap is formed therebetween. The first pressing unit 31 and the second pressing unit 32 rotate in opposite directions. The first pressing unit 31 and the second pressing unit 32 rotate in opposite directions while holding the sheet medium 20 therebetween to apply pressure to the sheet medium 20 to be sent out. It is sufficient that at least one of the first pressing unit 31 and the second pressing unit 32 rotates.

A region between the first pressing unit 31 and the second pressing unit 32 is referred to as a nip 50. A direction in which the first pressing unit 31 and the second pressing unit 32 approach to and separate from each other is referred to as an approaching/ separating direction X.

The conveying unit 33 conveys the sheet medium 20 to the nip 50. The conveying unit 33 conveys, for example, the sheet medium 20 with a roller. The conveying unit 33 may convey, for example, the sheet medium 20 with a belt or the like to which static electricity is charged.

The conveying unit 33 substantially vertically holds the sheet medium 20 with respect to the approaching/separating direction X, and causes a leading end of the sheet medium 20 to enter the nip 50. When the leading end of the sheet medium 20 enters the nip 50, the first pressing unit 31 and the second pressing unit 32 rotate in a direction in which the sheet medium 20 is rolled in while holding the sheet medium 20. Accordingly, the first pressing unit 31 and the second pressing unit 32 can send out the sheet medium 20 while applying pressure thereto, and can eject the sheet medium 20 from an opposite side. In this case, a direction in which the sheet medium 20 moves is referred to as a traveling direction Y.

The transfer belt 34 is a belt-shaped sheet, and formed in a ring shape. The transfer belt 34 is stretched over a path passing between the first pressing unit 31 and the second pressing unit 32. The transfer belt 34 is in contact with a side surface of any one of the first pressing unit 31 and the second pressing unit 32, and rotates in accordance with the rotation of the first pressing unit 31 and the second pressing unit 32. When the first pressing unit 31 and the second pressing unit 32 holds the sheet medium 20 therebetween, one surface of the transfer belt 34 is brought into contact with the sheet medium 20.

The image bearer 30 being a thin layer adheres to the surface of the transfer belt 34 with which the sheet medium 20 is to be in contact, before the belt enters the nip 50. For example, an image of the image bearer transferred from a rotary drum adheres to the transfer belt 34. The image bearer 30 enters the nip 50 together with the sheet medium 20. The image bearer 30 passes through the nip 50 while being in contact with a predetermined position on the surface of the sheet medium 20. When the sheet medium 20 and the image bearer 30 are passing through the nip 50, the first pressing unit 31 and the second pressing unit 32 apply a predetermined pressure thereto in the approaching/separating direction X. Accordingly, the image bearer 30 adhering to the surface of the transfer belt 34 is transferred onto the sheet medium 20. Thus, the image bearer 30 adheres to the surface of the sheet medium 20 after the sheet medium 20 has passed through the nip 50.

In this way, the pressure device 10 causes the sheet medium 20 and the image bearer 30 to enter the nip 50 at the same time, and sends out them to be ejected from the opposite side while applying a predetermined pressure thereto in the nip 50 to transfer the image bearer 30 onto a predetermined position of the sheet medium 20.

The supporting unit 35 supports the second pressing unit 32 movably toward the first pressing unit 31. The supporting unit 35 has substantially a rod shape, and the second pressing unit 32 is attached rotatably to one end thereof. When the supporting unit 35 rotates by a predetermined angle about a supporting unit center axis 35*a*, the second pressing unit 32 can be moved toward the first pressing unit 31. Thereby, the first pressing unit 31 and the second pressing unit 32 can approach to each other and separate from each other.

The elastic part 36 applies an elastic force to the supporting unit 35 such that the second pressing unit 32 moves toward the first pressing unit 31. The elastic part 36 is, for example, a spring. One end of the elastic part 36 is attached to the supporting unit 35, and the other end thereof is attached to a housing or the like of the device.

The driving unit 37 changes the position of the second pressing unit 32 to change a distance between the second pressing unit 32 and the first pressing unit 31. That is, the driving unit 37 changes a distance in the nip 50. The driving unit 37 is, for example, an actuator, and moves an end of the supporting unit 35 opposite to the second pressing unit 32.

The position measuring unit 38 detects the position of the second pressing unit 32.

The position measuring unit 38 is, for example, a sensor using an optical beam, and detects a moving position of the supporting unit 35.

The distance detection unit 41 detects the distance between the first pressing unit 31 and the second pressing unit 32 based on a measurement result obtained by the position measuring unit 38. That is, the distance detection unit 41 detects the distance in the nip 50. The distance detection unit 41 calculates, for example, the distance between the first pressing unit 31 and the second pressing unit 32 by performing an arithmetic operation based on the measurement result obtained by the position measuring unit 38. The distance detection unit 41 is, for example, implemented with a processor.

The control unit 42 performs feedback control on the driving unit 37 so that the distance between the first pressing unit 31 and the second pressing unit 32 becomes a set target value. More specifically, the control unit 42 calculates a difference between the set target value and the distance between the first pressing unit 31 and the second pressing unit 32 detected by the distance detection unit 41, and controls the driving unit 37 such that the difference becomes zero. The control unit 42 is, for example, implemented with a processor and a driver interface for controlling an operation of the driving unit 37.

The storage unit 43 stores the target value to be given to the control unit 42.

Specifically, the storage unit 43 stores two target values, that is, a first distance that is larger than the thickness of the sheet medium 20, and a second distance for applying a target pressure to the sheet medium 20.

The medium detection unit 44 detects whether the sheet medium 20 is present between the first pressing unit 31 and the second pressing unit 32. That is, the medium detection unit 44 detects whether the sheet medium 20 is present in the nip 50. The medium detection unit 44 determines that the sheet medium 20 is present in the nip 50 during a period from when the leading end of the sheet medium 20 enters the nip 50 until a trailing end of the sheet medium 20 leaves the nip 50. Such a medium detection unit 44 is, for example, implemented with a sensor for detecting the position of the sheet medium 20.

The image bearer detection unit 45 detects whether the image bearer 30 is present between the first pressing unit 31 and the second pressing unit 32. That is, the image bearer detection unit 45 detects whether the image bearer 30 is present in the nip 50. The image bearer detection unit 45 determines that the image bearer 30 is present in the nip 50 during a period from when a leading end of the image bearer 30 enters the nip 50 until a trailing end of the image bearer 30 leaves the nip 50. The image bearer detection unit 45 may be, for example, implemented with a sensor for detecting the position of the image bearer 30. The image bearer detection unit 45 may also be implemented by a processor or the like executing a computer program that determines the position of the image bearer 30 based on the position of the transfer belt 34 and/or the like.

The target setting unit 46 sets a target value of the feedback control performed by the control unit 42 based on a result of detecting whether the sheet medium 20 is present between the first pressing unit 31 and the second pressing unit 32 obtained by the medium detection unit 44, and a result of detecting whether the image bearer 30 is present between the first pressing unit 31 and the second pressing unit 32 obtained by the image bearer detection unit 45.

More specifically, if the sheet medium 20 is not present between the first pressing unit 31 and the second pressing unit 32, the target setting unit 46 sets the target value of the control unit 42 to the first distance that is larger than the thickness of the sheet medium 20. Accordingly, if the sheet medium 20 is not present between the first pressing unit 31 and the second pressing unit 32, the control unit 42 can control the distance between the first pressing unit 31 and the second pressing unit 32 to be the first distance.

If the sheet medium 20 and the image bearer 30 are present between the first pressing unit 31 and the second pressing unit 32, the target setting unit 46 sets the target value to the second distance for applying a target pressure to the sheet medium 20. Accordingly, if the sheet medium 20 and the image bearer 30 are present between the first pressing unit 31 and the second pressing unit 32, the control unit 42 can control the distance between the first pressing unit 31 and the second pressing unit 32 to be the second distance.

At a time when the leading end of the image bearer 30 is conveyed to a predetermined position before entering between the first pressing unit 31 and the second pressing unit 32, the target setting unit 46 switches the target value from the first distance to the second distance. For example, the target setting unit 46 switches the target value from the first distance to the second distance in a period from when the leading end of the sheet medium 20 enters between the first pressing unit 31 and the second pressing unit 32 until the leading end of the image bearer 30 enters between the first pressing unit 31 and the second pressing unit 32. The target setting unit 46 switches, for example, the target value from the first distance to the second distance at a timing when the leading end of the sheet medium 20 enters between the first pressing unit 31 and the second pressing unit 32.

The target setting unit 46 switches the target value from the second distance to the first distance in a period from when the trailing end of the image bearer 30 leaves between the first pressing unit 31 and the second pressing unit 32 until the trailing end of the sheet medium 20 leaves between the first pressing unit 31 and the second pressing unit 32. The target setting unit 46 switches, for example, the target value from the second distance to the first distance at a timing when the trailing end of the image bearer 30 leaves between the first pressing unit 31 and the second pressing unit 32.

Such a target setting unit 46 is, for example, implemented with a processor.

The abnormality detection unit 47 detects abnormality occurrence based on the distance between the first pressing unit 31 and the second pressing unit 32 detected by the distance detection unit 41 and the target value set by the target setting unit 46. More specifically, when the distance between the first pressing unit 31 and the second pressing unit 32 is smaller than the first distance as the target value at a timing when the leading end of the sheet medium 20 enters between the first pressing unit 31 and the second pressing unit 32, the abnormality detection unit 47 detects abnormality. Accordingly, in a case in which an impact is caused when the leading end of the sheet medium 20 is brought into contact with the first pressing unit 31 or the second pressing unit 32 at a time when the leading end of the sheet medium 20 enters therebetween, the abnormality detection unit 47 can detect abnormality.

When the distance between the first pressing unit 31 and the second pressing unit 32 deviates from a specified range that is specified based on the second distance as the target value when the sheet medium 20 and the image bearer 30 are present between the first pressing unit 31 and the second pressing unit 32, the abnormality detection unit 47 detects abnormality. Accordingly, the abnormality detection unit 47 can detect abnormality when the target pressure cannot be applied to the sheet medium 20 and the image bearer 30.

At a time when the abnormality is detected, the abnormality detection unit 47 performs corresponding processing. The abnormality detection unit 47 stops, for example, an operation of the device.

Figure 2:
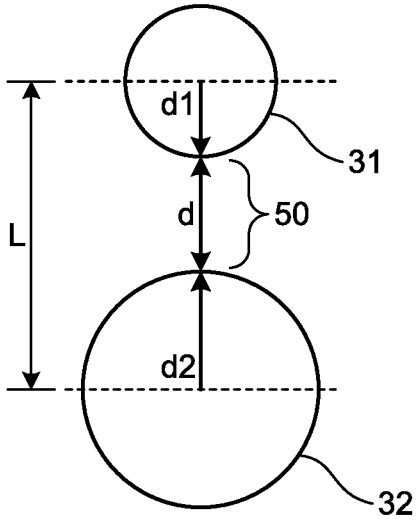
FIG. 2 is a diagram illustrating a state in which a first pressing unit is separated from a second pressing unit.

FIG. 2 is a diagram illustrating a state in which the first pressing unit 31 is separated from the second pressing unit 32. The nip 50 represents the space between the first pressing unit 31 and the second pressing unit 32. A distance d in the nip 50 can be calculated based on a distance L between the center position of the first pressing unit 31 and the center position of the second pressing unit 32. For example, assuming that a radius of the first pressing unit 31 is dl and a radius of the second pressing unit 32 is d2, the distance d in the nip 50 is calculated through the following expression (1).

$$d=L-(d1+d2) \quad (1)$$

When any one of the first pressing unit 31 and the second pressing unit 32 is not cylindrical, the radius dl or the radius d2 is a distance between the center position and the surface thereof.

Figure 3:
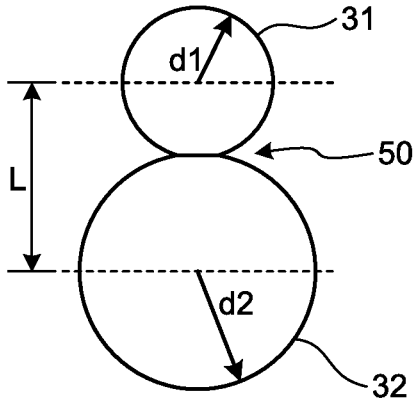
FIG. 3 is a diagram illustrating a state in which the first pressing unit is in contact with the second pressing unit.

FIG. 3 is a diagram illustrating a state in which the first pressing unit 31 is in contact with the second pressing unit 32. The first pressing unit 31 and the second pressing unit 32 may have predetermined elasticity. In this case, when the first pressing unit 31 is brought into contact with the second pressing unit 32 under a certain pressure or more, the first pressing unit 31 and the second pressing unit 32 are in contact with each other while being deformed. In such a case, in the present embodiment, the distance d in the nip 50 is treated as a negative value. Accordingly, also in such a case, the distance d in the nip 50 can be calculated through the expression (1).

Figure 4:
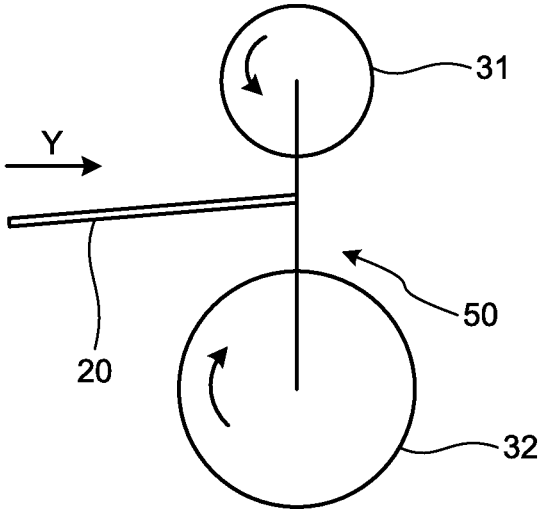
FIG. 4 is a diagram illustrating a state in which the sheet medium enters between the first pressing unit and the second pressing unit.

FIG. 4 is a diagram illustrating a state in which the sheet medium 20 enters between the first pressing unit 31 and the second pressing unit 32. When the sheet medium 20 is conveyed in the traveling direction Y, the leading end of the sheet medium 20 enters the nip 50. In this embodiment, a timing when the leading end of the sheet medium 20 reaches a straight line connecting the center position of the first pressing unit 31 and the center position of the second pressing unit 32 is defined as a timing when the leading end of the sheet medium 20 enters the nip 50.

Figure 5:
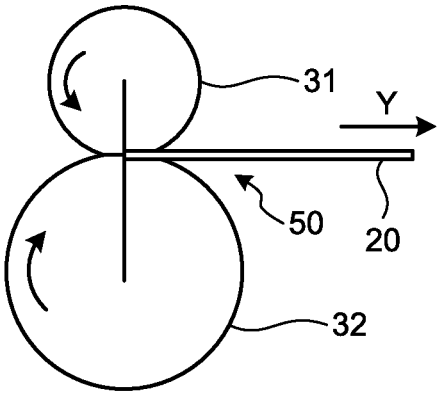
FIG. 5 is a diagram illustrating a state in which the sheet medium has left between the first pressing unit and the second pressing unit.

FIG. 5 is a diagram illustrating a state in which the sheet medium 20 has left between the first pressing unit 31 and the second pressing unit 32. After the sheet medium 20 has entered the nip 50, the first pressing unit 31 and the second pressing unit 32 rotate in opposite directions while applying pressure to the sheet medium 20 to send out the sheet medium 20. The trailing end of the sheet medium 20 then leaves the nip 50. A timing when the trailing end of the sheet medium 20 reaches the straight line connecting the center position of the first pressing unit 31 and the center position of the second pressing unit 32 is defined as a timing when the trailing end of the sheet medium 20 leaves the nip 50.

When one of the first pressing unit 31 and the second pressing unit 32 is not cylindrical, a timing when the leading end of the sheet medium 20 reaches a perpendicular drawn from a side surface of the cylinder is defined as an entering timing, and a timing when the trailing end of the sheet medium 20 reaches the perpendicular drawn from the side surface of the cylinder is defined as a leaving timing.

Figure 6:
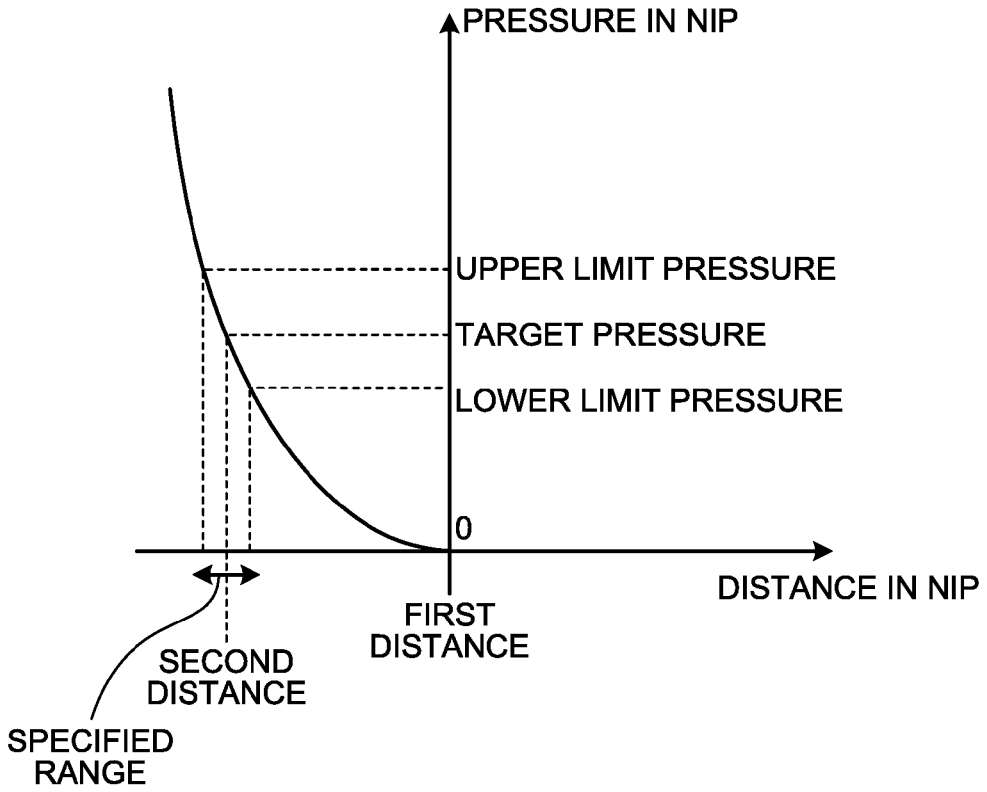
FIG. 6 is a diagram illustrating a relation between a distance and a pressure in a nip.

FIG. 6 is a diagram illustrating a relation between the distance in the nip 50 and a pressure in the nip 50. When the first pressing unit 31 and the second pressing unit 32 hold the sheet medium 20 therebetween, the pressure applied to the sheet medium 20 increases as the distance in the nip 50 is reduced. The pressure applied to the sheet medium 20 is zero when the distance in the nip 50 is larger than the thickness of the sheet medium 20.

When the sheet medium 20 is not present between the first pressing unit 31 and the second pressing unit 32, the target setting unit 46 gives the first distance that is larger than the thickness of the sheet medium 20 to the control unit 42 as the target value. Accordingly, when the sheet medium 20 enters the nip 50, the target setting unit 46 can prevent a pressure from being applied to the sheet medium 20 and prevent an impact from being caused on the sheet medium 20.

When the sheet medium 20 and the image bearer 30 are present between the first pressing unit 31 and the second pressing unit 32, the target setting unit 46 gives, to the control unit 42, the second distance for applying a target pressure to the sheet medium 20 as the target value. Accordingly, the target setting unit 46 can apply an appropriate pressure to the sheet medium 20 and the image bearer 30, and transfer the image bearer 30 onto the sheet medium 20.

When the pressure in the nip 50 is within a certain range (a range from a lower limit pressure to an upper limit pressure) including the target pressure, the image bearer 30 is transferred onto the sheet medium 20. Thus, the control unit 42 may control the distance in the nip 50 to be within a specified range in which a pressure in a range from the lower limit pressure to the upper limit pressure is applied.

The first distance and the second distance are, for example, calculated in advance, and written to the storage unit 43 from an external computer or the like. The target setting unit 46 reads out the first distance and the second distance stored in the storage unit 43 to set the target value.

Figure 7:
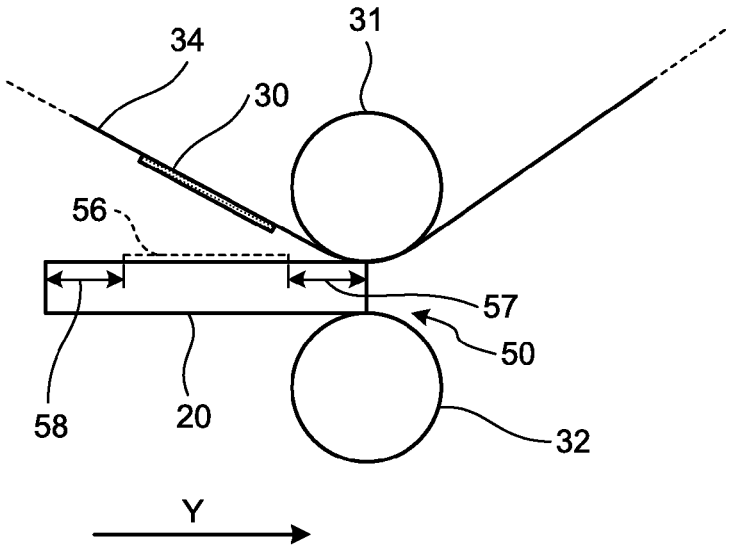
FIG. 7 is a diagram illustrating a transfer region in which an image bearer is transferred, and a leading end region and a trailing end region in which the image bearer is not transferred, on a surface of the sheet medium.

FIG. 7 is a diagram illustrating a transfer region 56 in which the image bearer 30 is transferred, and a leading end region 57 and a trailing end region 58 in which the image bearer 30 is not transferred, on the surface of the sheet medium 20.

The image bearer 30 is transferred in a partial region on the sheet medium 20. The region in which the image bearer 30 is transferred on the sheet medium 20 is defined as the transfer region 56. In a period in which the transfer region 56 is passing through the nip 50, the target setting unit 46 sets the target value of the distance between the first pressing unit 31 and the second pressing unit 32 to the second distance to apply the target pressure to the sheet medium 20.

In a period in which the sheet medium 20 is not present in the nip 50, the target setting unit 46 sets the target value of the distance between the first pressing unit 31 and the second pressing unit 32 to the first distance to cause the pressure applied to the sheet medium 20 to be zero.

The image bearer 30 is not transferred in the leading end region 57 closer to the leading end than the transfer region 56 on the sheet medium 20, and in the trailing end region 58 closer to the trailing end than the transfer region 56. Thus, a pressure lower than the target pressure may be applied to the leading end region 57 and the trailing end region 58.

The target setting unit 46 then switches the target value of the distance between the first pressing unit 31 and the second pressing unit 32 from the first distance to the second distance in a period in which the leading end region 57 is passing through the nip 50 to cause the pressure applied to the sheet medium 20 to reach the target pressure by the time when the leading end of the image bearer 30 is reached.

The target setting unit 46 switches the target value of the distance between the first pressing unit 31 and the second pressing unit 32 from the second distance to the first distance in a period in which the trailing end region 58 is passing through the nip 50 to cause the pressure applied to the sheet medium 20 to be lowered to zero by the time when the trailing end of the sheet medium 20 is reached.

The first distance may be any length so long as it is larger than the thickness of the sheet medium 20. However, the first distance is preferably a length of such a degree that the pressure can be switched by the control unit 42 and the driving unit 37 in an appropriate time period in the leading end region 57 and the trailing end region 58.

Figure 8:
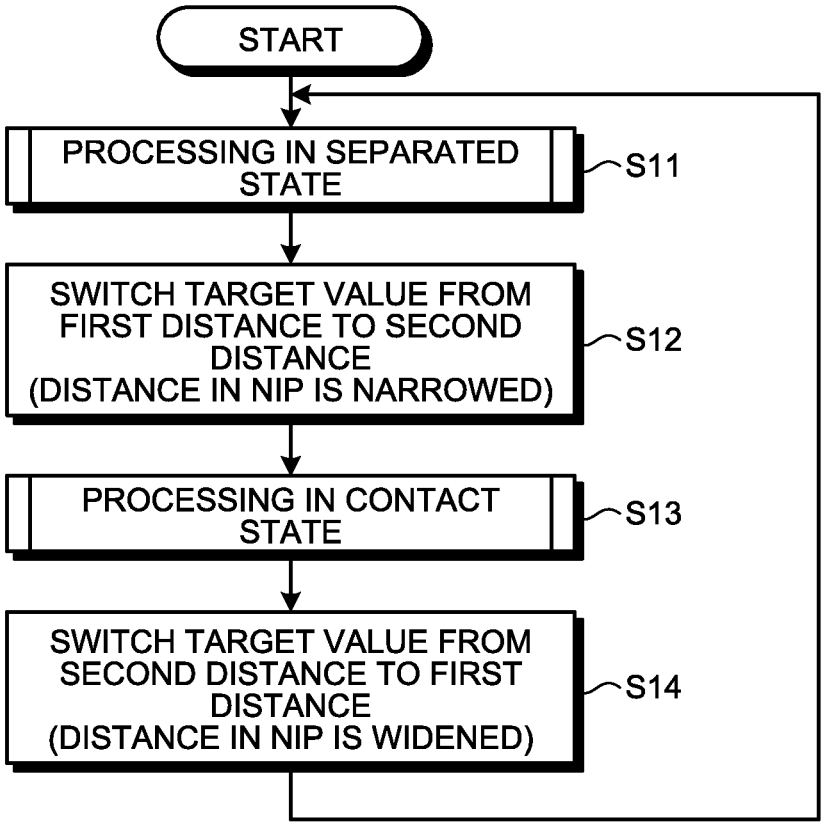
FIG. 8 is a flowchart illustrating a processing procedure of the pressure device.

FIG. 8 is a flowchart illustrating a processing procedure of the pressure device 10. When the sheet medium 20 is loaded and an operation is started, the pressure device 10 starts to perform processing from Step S11.

First, at Step S11, the target setting unit 46 performs processing in a separated state.

The processing in a separated state is processing when the first pressing unit 31 is separated from the second pressing unit 32. The processing in a separated state will be described later with reference to a flowchart illustrated in FIG. 9.

After the processing in a separated state is ended, at Step S12, the target setting unit 46 subsequently switches the target value given to the control unit 42 from the first distance to the second distance. Due to this switching, the target setting unit 46 can narrow the distance in the nip 50 from the distance that is larger than the thickness of the sheet medium 20 to the distance for applying the target pressure to the sheet medium 20.

Subsequently, at Step S13, the target setting unit 46 performs processing in a contact state. The processing in a contact state is processing when the first pressing unit 31 and the second pressing unit 32 hold the sheet medium 20 therebetween while applying pressure thereto. The processing in a contact state will be described later with reference to a flowchart illustrated in FIG. 10.

After the processing in a contact state is ended, at Step S14, the target setting unit 46 subsequently switches the target value given to the control unit 42 from the second distance to the first distance. Due to this switching, the target setting unit 46 can widen the distance in the nip 50 from the distance for applying the target pressure to the sheet medium 20 to the distance that is larger than the thickness of the sheet medium 20.

After Step S14 is ended, the target setting unit 46 returns the processing to Step S11. Subsequently, the processing from Step S11 to Step S14 is repeated for each sheet medium 20.

Figure 9:
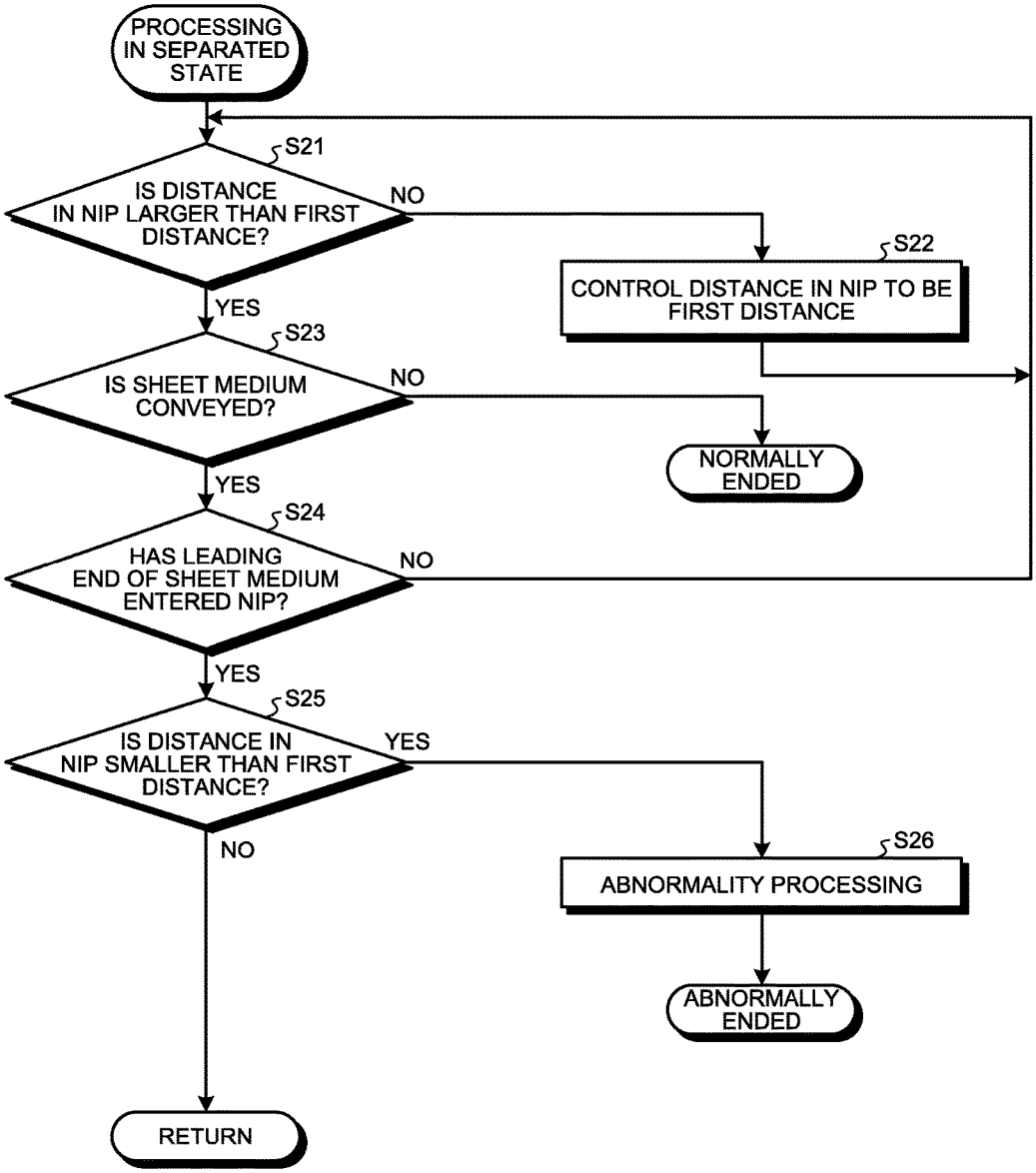
FIG. 9 is a flowchart illustrating a procedure of processing in a separated state.

FIG. 9 is a flowchart illustrating a procedure of the processing in a separated state.

The pressure device 10 performs processing illustrated in FIG. 9 in the processing in a separated state.

First, at Step S21, the target setting unit 46 determines whether the distance in the nip 50 is larger than the first distance. If the distance in the nip 50 is not larger than the first distance (No at S21), the target setting unit 46 advances the processing to Step S22. At Step S22, the control unit 42 controls the driving unit 37 such that the distance in the nip 50 becomes the first distance, and returns the processing to Step S21.

If the distance in the nip 50 is larger than the first distance (Yes at S21), at Step S23, the target setting unit 46 determines whether the sheet medium 20 is conveyed. If the sheet medium 20 is not conveyed (No at S23), the target setting unit 46 ends this procedure. When the processing is ended in a normal operation, the pressure device 10 ends the processing at this step. Accordingly, in the normal operation, the pressure device 10 ends the processing in a state in which the distance between the first pressing unit 31 and the second pressing unit 32 is larger than the thickness of the sheet medium 20.

If the sheet medium 20 is conveyed (Yes at S23), at Step S24, the target setting unit 46 determines whether the leading end of the sheet medium 20 has entered the nip 50. If the leading end of the sheet medium 20 has not entered the nip 50 yet (No at S24), the target setting unit 46 returns the processing to Step S21. If the leading end of the sheet medium 20 has entered the nip 50 (Yes at S24), the target setting unit 46 advances the processing to Step S25.

At Step S25, the abnormality detection unit 47 determines whether the distance in the nip 50 is smaller than the first distance as the target value of the processing in a separated state. If the distance in the nip 50 is equal to or larger than the first distance (No at S25), the abnormality detection unit 47 ends this procedure and returns the processing to Step S12 in FIG. 8.

If the distance in the nip 50 is smaller than the first distance (Yes at S25), the abnormality detection unit 47 performs abnormality processing at Step S26 and ends the processing. The abnormality detection unit 47 displays an alert for a user or stops the operation of the device as the abnormality processing. Alternatively, the abnormality detection unit 47 may end this procedure without stopping the operation of the device and return the processing to Step S12 in FIG. 8 after displaying the alert for the user. Consequently, the abnormality detection unit 47 can continue the processing while notifying that a normal pressure cannot be applied to the sheet medium 20.

Figure 10:
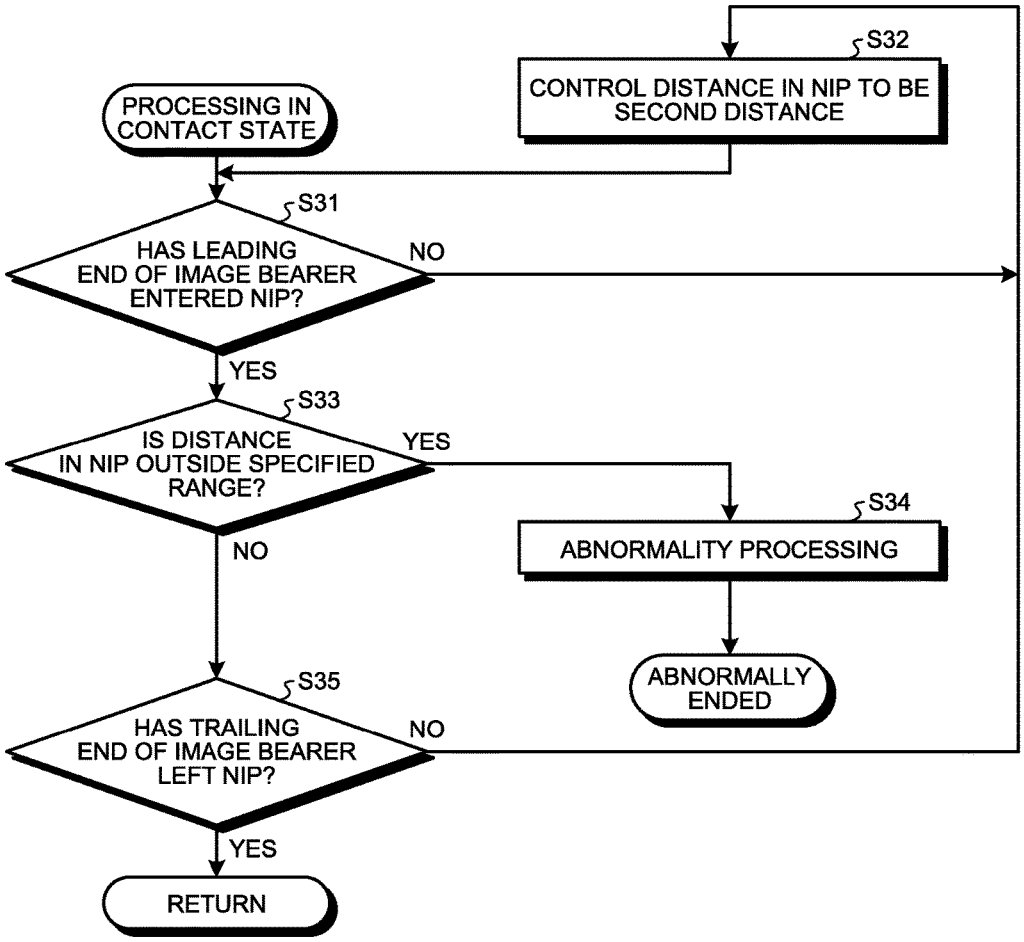
FIG. 10 is a flowchart illustrating a procedure of processing in a contact state.

FIG. 10 is a flowchart illustrating a procedure of the processing in a contact state. The pressure device 10 performs processing illustrated in FIG. 10 in the processing in a contact state.

At Step S31, the target setting unit 46 determines whether the leading end of the image bearer 30 has entered the nip 50. If the leading end of the image bearer 30 does not enter the nip 50 yet (No at S31), the target setting unit 46 advances the processing to Step S32. At Step S32, the control unit 42 controls the driving unit 37 such that the distance in the nip 50 becomes the second distance, and returns the processing to Step S31. If the leading end of the image bearer 30 has entered the nip 50 (Yes at S31), the target setting unit 46 advances the processing to Step S33.

At Step S33, the abnormality detection unit 47 determines whether the distance in the nip 50 is outside a specified range including the second distance as the target value of the processing in a contact state. At Step S33, if the distance in the nip 50 is within the specified range including the second distance as the target value of the processing in a contact state (No at S33), the abnormality detection unit 47 advances the processing to Step S35.

If the distance in the nip 50 is outside the specified range (Yes at S33), the abnormality detection unit 47 performs abnormality processing at Step S34 and ends the processing. The abnormality detection unit 47 displays an alert for the user or stops the operation of the device as the abnormality processing. Alternatively, the abnormality detection unit 47 may advance the processing to Step S35 without stopping the operation of the device after displaying the alert for the user. Consequently, the abnormality detection unit 47 can continue the processing while notifying that a normal pressure cannot be applied to the sheet medium 20.

At Step S35, the target setting unit 46 determines whether the trailing end of the image bearer 30 has left the nip 50. If the trailing end of the image bearer 30 has not left the nip 50 yet (No at S35), the target setting unit 46 advances the processing to Step S32. At Step S32, the control unit 42 controls the driving unit 37 such that the distance in the nip 50 becomes the second distance, and returns the processing to Step S31.

If the trailing end of the image bearer 30 has left the nip 50 (Yes at S35), the target setting unit 46 ends this procedure and returns the processing to Step S14 in FIG. 8.

As described above, the pressure device 10 according to the first embodiment causes the distance between the first pressing unit 31 and the second pressing unit 32 to be larger than the thickness of the sheet medium 20 when the leading end of the sheet medium 20 enters between the first pressing unit 31 and the second pressing unit 32. Accordingly, the pressure device 10 can prevent an impact from being caused when the leading end of the sheet medium 20 enters between the first pressing unit 31 and the second pressing unit 32.

When the sheet medium 20 and the image bearer 30 are present between the first pressing unit 31 and the second pressing unit 32, the pressure device 10 according to the first embodiment controls the distance between the first pressing unit 31 and the second pressing unit 32 to be within the specified range including the second distance that is set in advance. Accordingly, the pressure device 10 can apply an appropriate pressure to the sheet medium 20 and the image bearer 30.

After the trailing end of the image bearer 30 has left between the first pressing unit 31 and the second pressing unit 32, the pressure device 10 widens the distance between the first pressing unit 31 and the second pressing unit 32 to be the first distance. Accordingly, the pressure device 10 can reduce an impact caused when the sheet medium 20 leaves between the first pressing unit 31 and the second pressing unit 32.

Second Embodiment

Figure 11:
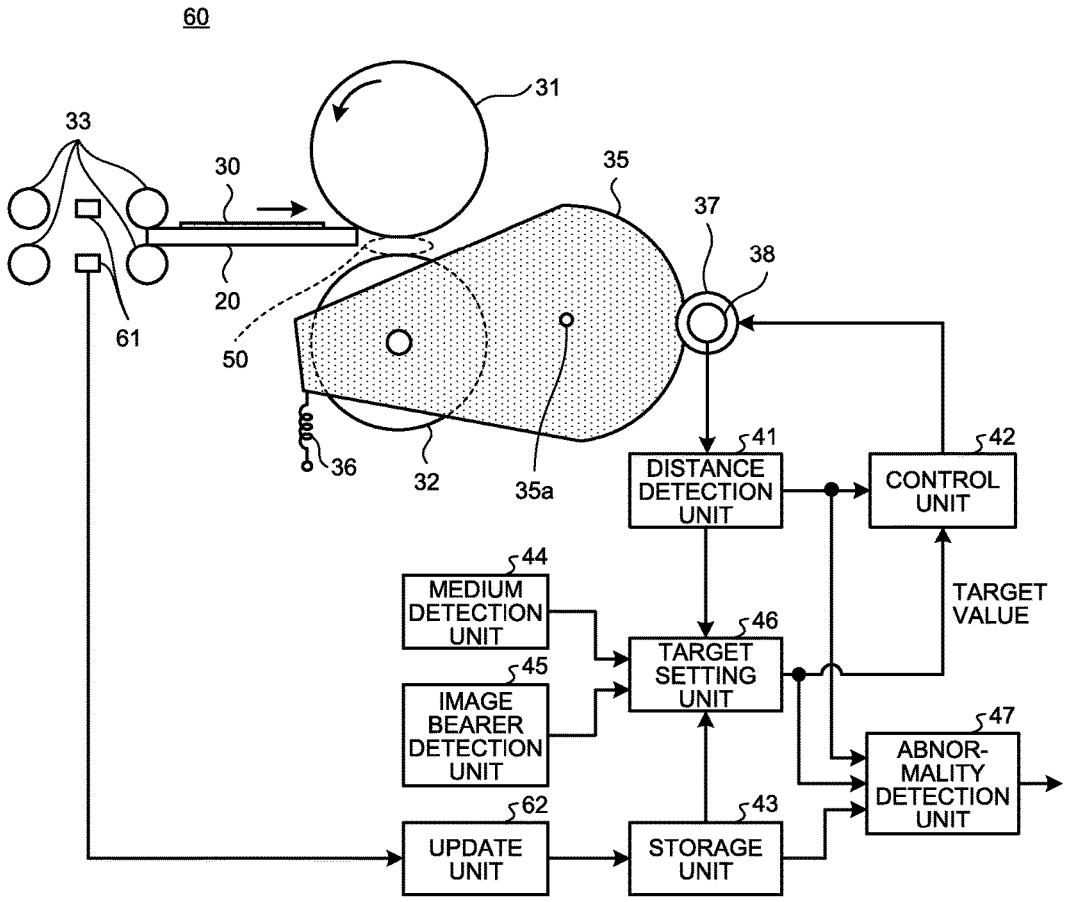
FIG. 11 is a diagram illustrating a configuration of a pressure device according to a second embodiment.

FIG. 11 is a diagram illustrating a configuration of a pressure device 60 according to a second embodiment. The pressure device 60 according to the second embodiment has a configuration and a function that are substantially the same as those of the pressure device 10 according to the first embodiment. In the description of the second embodiment, only differences will be described regarding members having substantially the same configuration and function as those in the first embodiment, and the detailed description will be omitted.

The pressure device 60 according to the present embodiment applies pressure and heat to the sheet medium 20 to which the image bearer 30 adheres on part of the surface thereof. The pressure device 60 according to the present embodiment is, for example, applied to a fixing unit of an electrophotographic type image forming apparatus. The pressure device 60 according to the present embodiment may be configured to apply pressure to the sheet medium 20 to which the image bearer 30 adheres through an indirect transfer system, or may apply pressure to the sheet medium 20 to which the image bearer 30 adheres through a direct transfer system. In this example, the pressure device 60 according to the present embodiment applies pressure and heat. However, the pressure device 60 according to the present embodiment may be configured to apply only a pressure.

The pressure device 60 includes a medium sensor 61 and an update unit 62 in addition to the components included in the pressure device 10 illustrated in FIG. 1. In this embodiment, the pressure device 60 does not include the transfer belt 34.

The conveying unit 33 conveys the sheet medium 20 to which the image bearer 30 adheres on part of the surface thereof, between the first pressing unit 31 and the second pressing unit 32. The first pressing unit 31 and the second pressing unit 32 are connected to a heater or the like, and apply pressure and a predetermined amount of heat to the sheet medium 20. Due to this pressurizing and heating, the first pressing unit 31 and the second pressing unit 32 melts and cools the image bearer 30 adhering to the sheet medium 20, and can cause the image bearer 30 to be fixed onto the sheet medium 20.

The supporting unit 35 has a thin-plate shape, and an end closer to the driving unit 37 is part of a circular arc centered on the supporting unit center axis 35*a*. The driving unit 37 is a motor. A rotation axis of the driving unit 37 is connected to the circular arc of the supporting unit 35 such that a rotational force is transmitted. The driving unit 37 rotates the rotation axis in response to control by the control unit 42 to cause the second pressing unit 32 to approach to or separate from the first pressing unit 31.

The medium sensor 61 measures a characteristic of the sheet medium 20. In this embodiment, the medium sensor 61 functions as a measuring unit for measuring the thickness of the sheet medium 20. The medium sensor 61 measures the thickness while the conveying unit 33 conveys the sheet medium 20.

The update unit 62 updates the first distance stored in the storage unit 43 in accordance with the thickness of the sheet medium 20 measured by the medium sensor 61. The update unit 62 may update the first distance for each of a plurality of sheet media 20. When successively applying pressure to sheet media 20 of the same type, the update unit 62 may update the first distance for the first sheet medium 20, and does not necessarily perform the update for the following sheet media 20.

Figure 12:
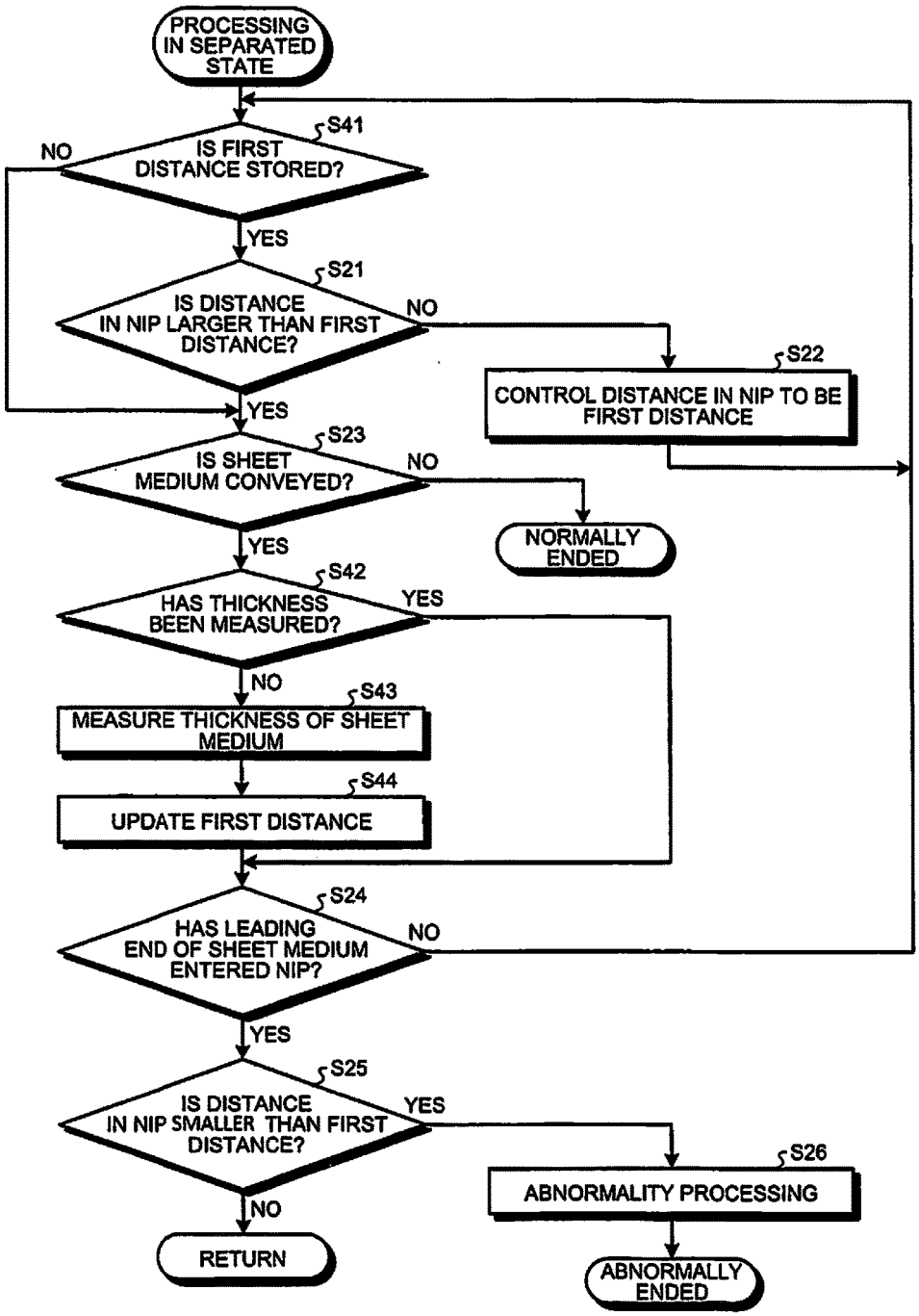
FIG. 12 is a flowchart illustrating a procedure of processing in a separated state of the pressure device according to the second embodiment.

FIG. 12 is a flowchart illustrating a procedure of the processing in a separated state of the pressure device 60 according to the second embodiment. The pressure device 60 according to the second embodiment performs substantially the same processing as that illustrated in FIG. 8 to FIG. 10. The following describes differences therebetween.

When the processing in a separated state is started, at Step S41, the update unit 62 first determines whether the first distance is stored in the storage unit 43. If the first distance is stored in the storage unit 43 (Yes at S41), the update unit 62 advances the processing to Step S21. If the first distance is not stored in the storage unit 43 (No at S41), the update unit 62 advances the processing to Step S23. By performing the determining processing at Step S41, the distance in the nip 50 can be prevented from being controlled in a state in which the first distance is not stored. Instead of the processing at Step S41, an initial value may be set to the first distance.

If it is determined that the sheet medium 20 is conveyed at Step S23 (Yes at S23), the update unit 62 advances the processing to Step S42.

At Step S42, the update unit 62 determines whether the thickness of the sheet medium 20 has been measured. If the thickness of the sheet medium 20 has been measured (Yes at S42), the update unit 62 advances the processing to Step S24.

If the thickness of the sheet medium 20 has not been measured (No at S42), at Step S43, the update unit 62 causes the medium sensor 61 to measure the thickness of the sheet medium 20, and acquires a measurement result. At Step S44, the update unit 62 calculates the first distance based on the measurement result of the thickness of the sheet medium 20, and updates the first distance stored in the storage unit 43. After the processing at Step S44 is ended, the update unit 62 advances the processing to Step S24.

By performing the processing at Step S42, one sheet medium 20 can be measured once. Alternatively, thicknesses of a plurality of different portions of one sheet medium 20 may be measured. Accordingly, the pressure device 60 can control the pressure with higher accuracy.

As described above, the pressure device 60 according to the second embodiment does not necessarily set the first distance corresponding to the thickness of the sheet medium 20 in advance. Consequently, with the pressure device 60 according to the second embodiment, the same effect as that of the first embodiment can be obtained and labor for setting can be saved. With the pressure device 60 according to the second embodiment, even in a case in which the pressure to sheet media 20 having various thicknesses, an impact can be prevented from being caused when the leading end of the sheet medium 20 enters between the first pressing unit 31 and the second pressing unit 32.

Third Embodiment

The pressure device 60 according to a third embodiment has the same configuration as that in the second embodiment illustrated in FIG. 11. However, the medium sensor 61 functions as a type detection unit for detecting a type of the sheet medium 20. The medium sensor 61 detects, for example, a material of the sheet medium 20 (for example, paper or a film). The medium sensor 61 may detect a type of paper (Kent paper, copy paper, certificate paper, tracing paper, or the like). The medium sensor 61 may also detect a manufacturer, a commodity number or the like of the sheet.

The update unit 62 updates the second distance stored in the storage unit 43 in accordance with the type of the sheet medium 20 detected by the medium sensor 61. For example, the update unit 62 stores a correspondence relation between the type and the second distance in advance, and causes the storage unit 43 to store the second distance corresponding to the detected type. The update unit 62 may update the second distance for each of the sheet media 20. When successively applying pressure to the sheet media 20 of the same type, the update unit 62 may update the second distance for the first sheet medium 20, and does not necessarily perform the update for the following sheet media 20.

Figure 13:
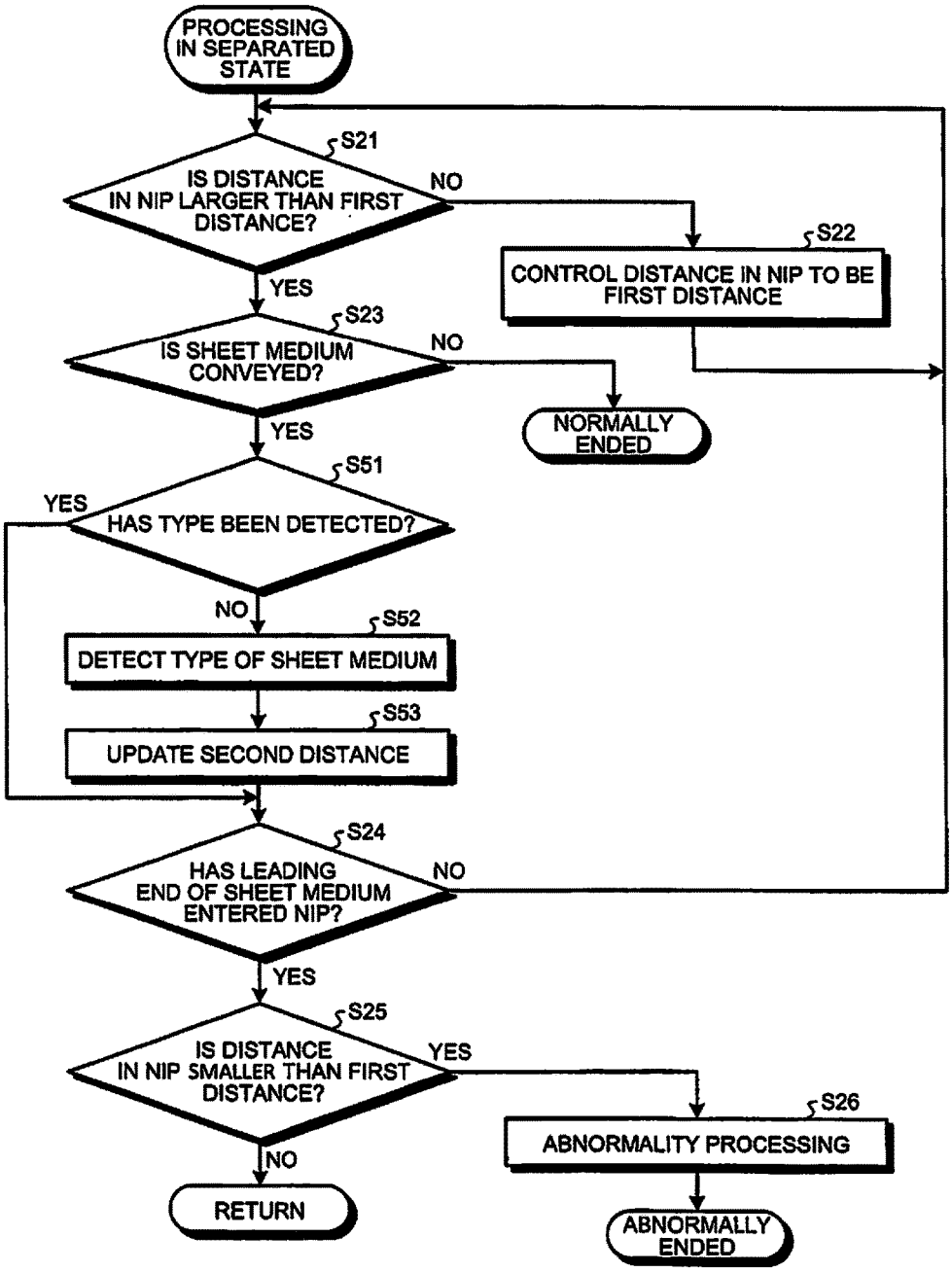
FIG. 13 is a flowchart illustrating a procedure of processing in a separated state of a pressure device according to a third embodiment.

FIG. 13 is a flowchart illustrating a procedure of the processing in a separated state of the pressure device 60 according to the third embodiment. The pressure device 60 according to the third embodiment performs substantially the same processing as that illustrated in FIG. 8 to FIG. 10. The following describes differences therebetween.

If it is determined that the sheet medium 20 is conveyed at Step S23 (Yes at S23), the update unit 62 advances the processing to Step S51. At Step S51, the update unit 62 determines whether the type of the sheet medium 20 has been detected. If the type of the sheet medium 20 has been detected (Yes at S51), the update unit 62 advances the processing to Step S24.

If the type of the sheet medium 20 has not been detected (No at S51), at Step S52, the update unit 62 causes the medium sensor 61 to detect the type of the sheet medium 20, and acquires a detection result. At Step S53, the update unit 62 acquires the second distance based on the detection result of the type of the sheet medium 20, and updates the second distance stored in the storage unit 43. After the processing at Step S53 is ended, the update unit 62 advances the processing to Step S24.

Figure 14:
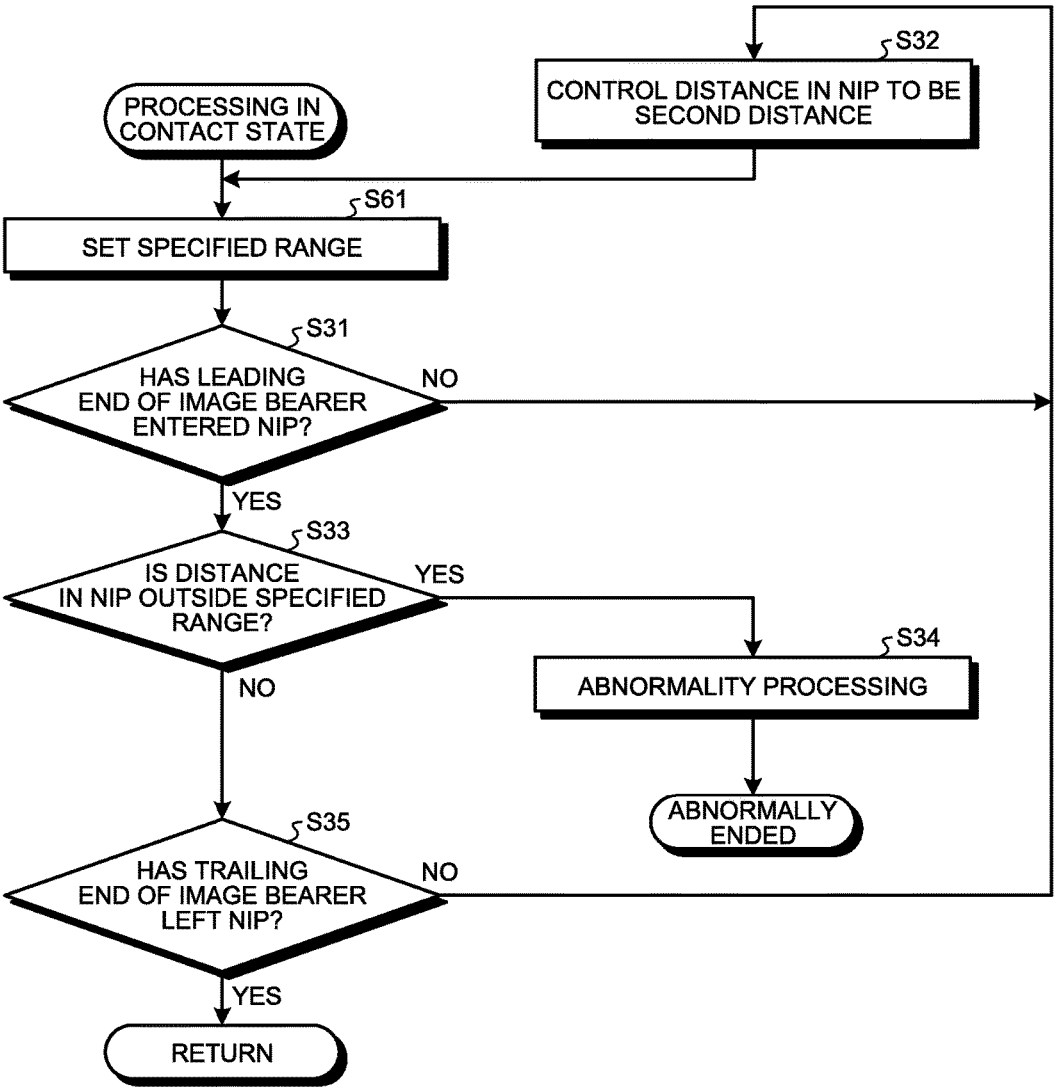
FIG. 14 is a flowchart illustrating a procedure of processing in a contact state of the pressure device according to the third embodiment.

FIG. 14 is a flowchart illustrating a procedure of the processing in a contact state of the pressure device 60 according to the third embodiment. When the processing in a contact state is started, at Step S61, the abnormality detection unit 47 first calculates a specified range to be set based on the second distance. The specified range is a range including the second distance, and specified with an upper limit value larger than the second distance and a lower limit value smaller than the second distance. When the setting of the specified range is completed, the abnormality detection unit 47 advances the processing to Step S31.

As described above, the pressure device 60 according to the third embodiment does not necessarily set the second distance corresponding to the thickness of the sheet medium 20 in advance. Accordingly, with the pressure device 60 according to the third embodiment, the same effect as that of the first embodiment can be obtained and labor for setting can be saved.

For example, an appropriate pressure varies depending on the material of the sheet medium 20 and a frictional force of the surface thereof. The pressure device 60 according to the third embodiment can apply an appropriate pressure to the sheet medium 20 irrespective of the type of the sheet medium 20.

The pressure device 60 may have a configuration combining the function according to the second embodiment and the function according to the third embodiment. In this case, the medium sensor 61 detects both of the thickness and the type of the sheet medium 20. In addition, in this case, the update unit 62 updates both of the first distance and the second distance.

Configuration Example of Medium Sensor 61

Figure 15:
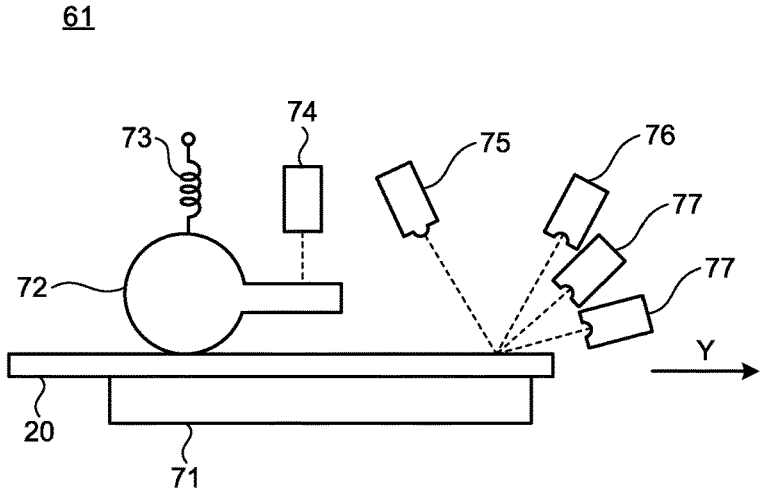
FIG. 15 is a diagram illustrating a configuration of a medium sensor together with the sheet medium.

FIG. 15 is a diagram illustrating a configuration of the medium sensor 61 together with the sheet medium 20. The following describes an example of the medium sensor 61 according to the second embodiment and the third embodiment.

The medium sensor 61 includes, for example, a bottom plate 71, a roller 72, a spring 73, a roller displacement sensor 74, a light emitting unit 75, a specular reflection light receiving unit 76, and a diffused light receiving unit 77.

The sheet medium 20 is placed on the bottom plate 71. When being conveyed by the conveying unit 33 in the traveling direction Y, the sheet medium 20 passes over the bottom plate 71. When the sheet medium 20 is passing over the bottom plate 71, the roller 72 is brought into contact with the surface of the sheet medium 20 opposite to the bottom plate 71. The spring 73 presses the roller 72 against the bottom plate 71. The roller displacement sensor 74 measures a displacement amount of the roller 72.

In the medium sensor 61, when the sheet medium 20 is passing over the bottom plate 71, the position of the roller 72 is changed corresponding to the thickness of the sheet medium 20. Thus, the medium sensor 61 outputs the displacement amount measured by the roller displacement sensor 74 as the thickness of the sheet medium 20.

The light emitting unit 75 emits light to the sheet medium 20 passing over the bottom plate 71. The specular reflection light receiving unit 76 detects specular reflection light of the light emitted from the light emitting unit 75 to the sheet medium 20. The diffused light receiving unit 77 detects diffused light of the light emitted from the light emitting unit 75 to the sheet medium 20. The medium sensor 61 may have a plurality of diffused light receiving units 77. In this case, the diffused light receiving units 77 detect pieces of diffused light of different angles.

Intensity of the reflected light and the diffused light varies depending on the material and the like of the sheet medium 20. The medium sensor 61 outputs the intensity of the reflected light and the pieces of diffused light of respective angles as the type of the medium. For example, when a commodity number and/or the like are printed as a bar code at a predetermined position on the surface of the sheet medium 20, the intensity of the reflected light at the predetermined position may be output as the type. The medium sensor 61 can detect the thickness and the type of the sheet medium 20 with another configuration, not limited to the above configuration.

Configuration of Image Forming Apparatus 110

Figure 16:
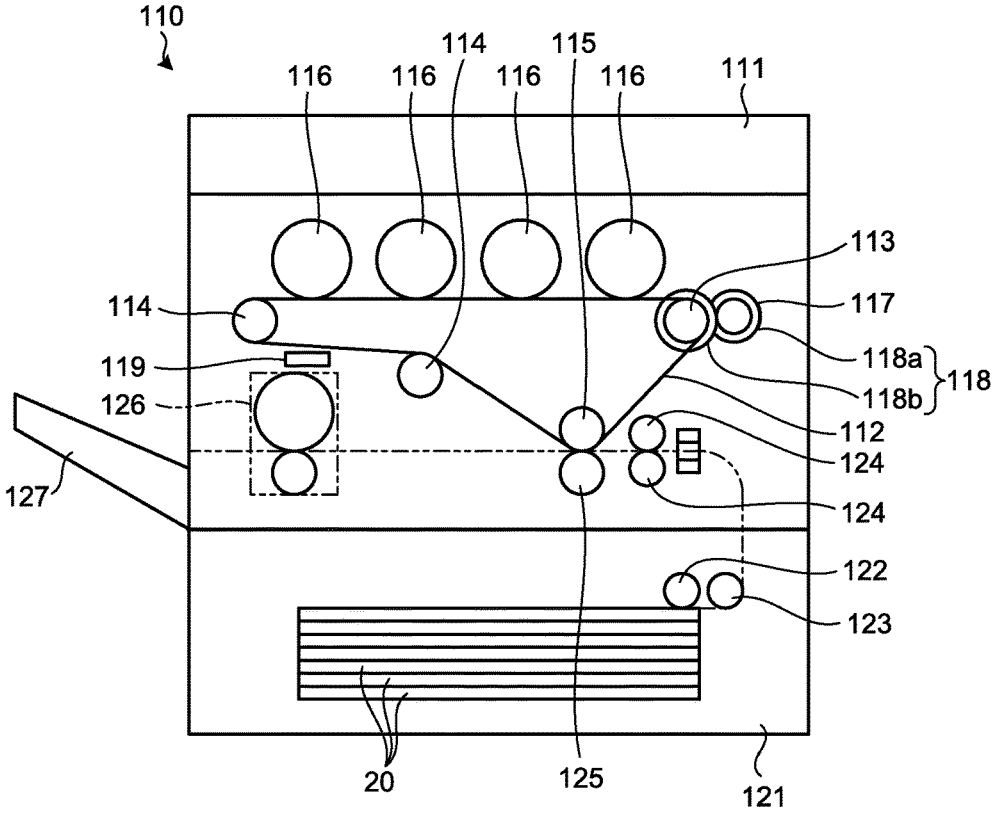
FIG. 16 is a diagram illustrating a configuration of an image forming apparatus.

FIG. 16 is a diagram illustrating a configuration of an image forming apparatus 110. The pressure device 10 and the pressure device 60 described in the first to third embodiments can be applied, for example, to part of a tandem color electrophotographic type image forming apparatus 110.

The image forming apparatus 110 includes a scanner unit 111, an intermediate transfer belt 112, a driving roller 113, two driven rollers 114, a repulsive roller 115, four photoconductor units 116, a motor 117, a deceleration mechanism 118, a belt encoder sensor 119, a sheet feeding unit 121, a sheet feeding roller 122, a sheet conveyance roller 123, two registration rollers 124, a secondary transfer roller 125, a fixing unit 126, and a paper ejection unit 127.

The scanner unit 111 reads an image of a document placed on an upper surface of a document platen. The intermediate transfer belt 112 is stretched across the driving roller 113, the driven rollers 114, and the repulsive roller 115.

The four photoconductor units 116 correspond to respective four colors, that is, yellow (Y), cyan (C), magenta (M), and black (K). Each of the photoconductor units 116 includes various components such as a drum-shaped photoconductor drum serving as a latent image bearer and a photoconductor cleaning roller.

The photoconductor units 116 superimpose toner images of respective colors of YCMK on the intermediate transfer belt 112 serving as an image forming medium to form a full-color image. The photoconductor units 116 are not limited thereto. For example, three photoconductor units 116 corresponding to respective colors of YCM may be arranged in the image forming apparatus 110.

The driving roller 113 drives the intermediate transfer belt 112. The motor 117 drives the driving roller 113 via the deceleration mechanism 118. The deceleration mechanism 118 includes gear wheels 118*a* and 118*b* having different number of teeth. The gear wheels 118*a* and 118*b* are engaged with each other, and decelerate rotation of the motor 117 to transmit the rotation to the driving roller 113.

The belt encoder sensor 119 is an encoder for measuring a surface speed of the intermediate transfer belt 112. The belt encoder sensor 119 detects a scale formed on the intermediate transfer belt 112 to generate a pulse output.

The sheet feeding unit 121 accommodates a plurality of sheet media 20 in a stacked state. The sheet medium 20 is, for example, a sheet. The sheet feeding roller 122 sends out the sheet medium 20 from the sheet feeding unit 121 to a conveyance path represented by a chain double-dashed line. The sheet conveyance roller 123 is arranged in the conveyance path, and conveys the sheet medium 20 sent out from the sheet feeding roller 122 to the registration roller 124. The registration roller 124 performs skew correction of the sheet medium 20 and conveys the sheet medium 20, for example.

The secondary transfer roller 125 is arranged to be opposed to the repulsive roller 115. The repulsive roller 115 forms and maintains the nip 50 between the intermediate transfer belt 112 and the secondary transfer roller 125. The secondary transfer roller 125 transfers the toner images of respective colors of YCMK formed on the intermediate transfer belt 112 by the photoconductor units 116 onto the sheet medium 20 passing through the nip 50.

The secondary transfer roller 125 is freely rotatable. For example, the secondary transfer roller 125 is rotated by being brought into contact with the intermediate transfer belt 112 or the sheet medium 20 that is being conveyed. The image forming apparatus 110 may have a mechanism for rotating and driving the secondary transfer roller 125.

The fixing unit 126 fixes the toner images transferred by the secondary transfer roller 125 onto the sheet medium 20 by heating and pressurizing. The sheet medium 20 onto which the toner images are transferred and fixed is ejected to the paper ejection unit 127.

When the pressure device 10 is applied to the transfer unit of the image forming apparatus 110 having such a configuration, the repulsive roller 115 functions as the first pressing unit 31, and the secondary transfer roller 125 functions as the second pressing unit 32. The pressure device 60 is applied to the fixing unit 126 of the image forming apparatus 110 having such a configuration. When the pressure device 10 and the pressure device 60 are applied to both of the transfer unit and the fixing unit 126 of the image forming apparatus 110, the medium sensor 61 may be implemented with a common member.

Figure 17:
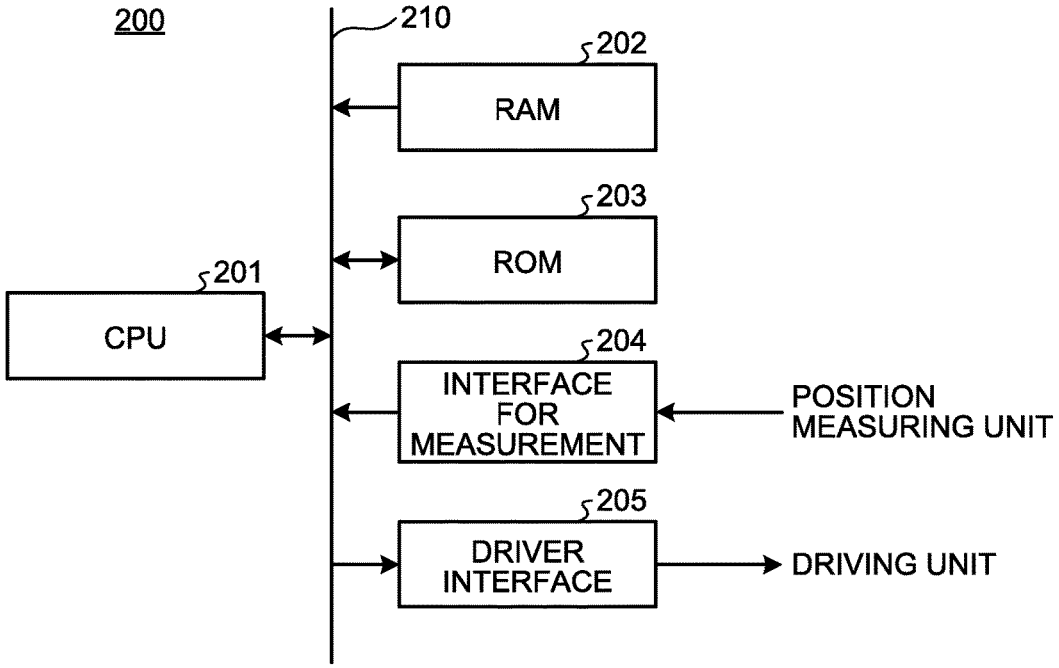
FIG. 17 is a diagram illustrating a configuration of an information processing unit.

FIG. 17 is a diagram illustrating a configuration of an information processing unit 200. The image forming apparatus 110 includes the information processing unit 200 for controlling the apparatus. The information processing unit 200 includes a central processing unit (CPU) 201, a random access memory (RAM) 202, a read only memory (ROM) 203, an interface for measurement 204, and a driver interface 205. These components are connected with each other via a bus 210.

The CPU 201 is a processor that performs arithmetic processing, control processing, and the like in accordance with a computer program. The CPU 201 performs various pieces of processing in cooperation with the computer program stored in the ROM 203 and/or the like using a predetermined region of the RAM 202 as a working area.

The RAM 202 is a memory such as a synchronous dynamic random access memory (SDRAM). The RAM 202 functions as the working area of the CPU 201. The ROM 203 is a memory that stores the computer program and various pieces of information in a non-rewritable manner.

The interface for measurement 204 is an interface for acquiring a detection result of a sensor and/or the like inside the apparatus. The driver interface 205 is an interface for driving a motor, an actuator, and/or the like inside the apparatus.

When the pressure device 10 and the pressure device 60 are applied to the image forming apparatus 110, the information processing unit 200 functions, for example, as the distance detection unit 41, the control unit 42, the storage unit 43, the target setting unit 46, the abnormality detection unit 47, and the update unit 62. In this case, the computer program executed by the information processing unit 200 has a module configuration including a distance detection module, a control module, a storage module, a target setting module, an abnormality detection module, and an update module. When the computer program is loaded and executed on the RAM 202 by the CPU 201 (processor), the information processing unit 200 is made to function as the distance detection unit 41, the control unit 42, the storage unit 43, the target setting unit 46, the abnormality detection unit 47, and the update unit 62. Alternatively, at least some of the distance detection unit 41, the control unit 42, the storage unit 43, the target setting unit 46, the abnormality detection unit 47, and the update unit 62 may be implemented as a hardware circuit (for example, a semiconductor integrated circuit) instead of being implemented with the information processing unit 200.

The embodiments of the present invention have been described above. The embodiments are merely an example, and do not intend to limit the scope of the invention. These novel embodiments can be implemented in various other forms.

REFERENCE SIGNS LIST

10 Pressure device
20 Sheet medium
30 Image bearer
31 First pressing unit
32 Second pressing unit
33 Conveying unit
34 Transfer belt
35 Supporting unit
35*a* Supporting unit center axis
36 Elastic part
37 Driving unit
38 Position measuring unit
41 Distance detection unit
42 Control unit
43 Storage unit
44 Medium detection unit
45 Image bearer detection unit
46 Target setting unit
47 Abnormality detection unit
50 Nip
56 Transfer region
57 Leading end region
58 Trailing end region
60 Pressure device
61 Medium sensor
62 Update unit
71 Bottom plate
72 Roller
73 Spring
74 Roller displacement sensor
75 Light emitting unit
76 Specular reflection light receiving unit
77 Diffused light receiving unit
110 Image forming apparatus
111 Scanner unit
112 Intermediate transfer belt
113 Driving roller
114 Driven roller
115 Repulsive roller
116 Photoconductor unit
117 Motor
118 Deceleration mechanism
118*a* Gear wheel
118*b* Gear wheel
119 Belt encoder sensor
121 Sheet feeding unit
122 Sheet feeding roller
123 Sheet conveyance roller
124 Registration roller
125 Secondary transfer roller
126 Fixing unit
127 Paper ejection unit
200 Information processing unit
201 CPU
202 RAM
203 ROM
204 Interface for measurement
205 Driver interface
210 Bus

CITATION LIST

Patent Literature

[PTL 1] Japanese Laid-open Patent Publication No. 2010-151983

[PTL 2] Japanese Laid-open Patent Publication No. 5-289569

[PTL 3] Japanese Laid-open Patent Publication No. 2009-276383

The invention claimed is:

1. A pressure device configured to apply pressure to a sheet medium on part of a surface of which an image bearer is formed, the pressure device comprising:

a first pressing unit and a second pressing unit, movable to approach to and separate from each other, and configured to apply pressure to the sheet medium by at least one of the first pressing unit and the second pressing unit rotating in a state in which at least one of the first pressing unit and the second pressing unit hold the sheet medium;

a driving unit configured to change a relative distance between the first pressing unit and the second pressing unit;

a distance detection unit configured to detect the distance between the first pressing unit and the second pressing unit;

a control unit configured to control the driving unit to adjust the relative distance between the first pressing unit and the second pressing unit to a target value; and a target setting unit configured to set the target value for control of the driving unit, the target setting unit being configured to set the target value to a first distance that is relatively larger than a thickness of the sheet medium, in a period during which the sheet medium is not present between the first pressing unit and the second pressing unit, and set the target value to a second distance, in a period during which the sheet medium and the image bearer are present between the first pressing unit and the second pressing unit, for application of a target pressure to the sheet medium via control of the driving unit based upon the second distance, wherein pressure applied to the sheet medium is controllable based upon control of the relative distance between the first pressing unit and the second pressing unit.

2. The pressure device according to claim 1, further comprising:

a conveying unit configured to convey the sheet medium between the first pressing unit and the second pressing unit, wherein the target setting unit is configured to switch the target value from the first distance to the second distance at a time when a leading end of the image bearer is conveyed to a target position before entering between the first pressing unit and the second pressing unit.

3. The pressure device according to claim 2, wherein the target setting unit is configured to switch the target value from the first distance to the second distance in a period from when a leading end of the sheet medium enters between the first pressing unit and the second pressing unit until a leading end of the image bearer enters between the first pressing unit and the second pressing unit.

4. The pressure device according to claim 2, wherein the target setting unit is configured to switch the target value from the second distance to the first distance in a period from when a trailing end of the image bearer leaves between the first pressing unit and the second pressing unit until a trailing end of the sheet medium leaves between the first pressing unit and the second pressing unit.

5. The pressure device according to claim 1, further comprising:

an abnormality detection unit configured to detect an abnormality, upon the distance between the first pressing unit and the second pressing unit being relatively smaller than the first distance, and upon a leading end of the sheet medium entering between the first pressing unit and the second pressing unit.

6. The pressure device according to claim 5, wherein the abnormality detection unit is configured to detect the abnormality upon the distance between the first pressing unit and the second pressing unit deviating from a specified range including the second distance, and upon the sheet medium and the image bearer being present between the first pressing unit and the second pressing unit.

7. The pressure device according to claim 1, further comprising:

a measuring unit configured to measure the thickness of the sheet medium; and an update unit configured to update the first distance in accordance with the thickness measured by the measuring unit.

8. The pressure device according to claim 1, further comprising:

a type detection unit configured to detect a type of the sheet medium; and an update unit configured to update the second distance in accordance with the type detected by the type detection unit.

9. The pressure device according to claim 1, wherein the pressure is relatively increased as the second distance is relatively reduced.

10. An image forming apparatus configured to form an image on a sheet medium, the image forming apparatus comprising:

a transfer unit configured to transfer an image bearer formed on a surface of an intermediate transfer belt onto the sheet medium, the transfer unit comprising:

a first pressing unit and a second pressing unit, each being movable to approach to and separate from the other of the second pressing unit and first pressing unit, and each configured to send out the sheet medium while applying pressure to the sheet medium by at least one of the first pressing unit and the second pressing unit rotating in a state in which at least one of the first pressing unit and the second pressing unit hold the sheet medium;

a driving unit configured to change a relative distance between the first pressing unit and the second pressing unit;

a distance detection unit configured to detect the distance between the first pressing unit and the second pressing unit;

a control unit configured to control the driving unit to adjust the relative distance between the first pressing unit and the second pressing unit to a target value; and a target setting unit configured to set the target value, the target setting unit being configured to set the target value to a first distance that is relatively larger than a thickness of the sheet medium, in a period during which the sheet medium is not present between the first pressing unit and the second pressing unit, and set the target value to a second distance, in a period during which the sheet medium and the image bearer are present between the first pressing unit and the second pressing unit, for application of a target pressure to the sheet medium via control of the driving unit based upon the second distance, wherein pressure applied to the sheet medium is controllable based upon control of the relative distance between the first pressing unit and the second pressing unit.

11. The image forming apparatus of claim 10, wherein the transfer unit further includes:

an abnormality detection unit configured to detect an abnormality, upon the distance between the first pressing unit and the second pressing unit being relatively smaller than the first distance, and upon a leading end of the sheet medium entering between the first pressing unit and the second pressing unit.

12. The image forming apparatus of claim 11, wherein the abnormality detection unit is configured to detect the abnormality upon the distance between the first pressing unit and the second pressing unit deviating from a specified range including the second distance, and upon the sheet medium and the image bearer being present between the first pressing unit and the second pressing unit.

13. The image forming apparatus of claim 10, wherein the pressure is relatively increased as the second distance is relatively reduced.

14. A method of controlling a pressure device configured to apply pressure to a sheet medium on part of a surface of which an image bearer is formed, the pressure device including:

a first pressing unit and a second pressing unit, each being movable to approach and separate from the other of the second pressing unit and first pressing unit, and each configured to send out the sheet medium while applying pressure to the sheet medium by at least one of the first pressing unit and the second pressing unit rotating in a state in which at least one of the first pressing unit and the second pressing unit hold the sheet medium;

a driving unit configured to change a relative distance between the first pressing unit and the second pressing unit;

a distance detection unit configured to detect the distance between the first pressing unit and the second pressing unit;

a control unit configured to control the driving unit to adjust the relative distance between the first pressing unit and the second pressing unit to a set target value; and a target setting unit configured to set the target value, the method comprising:

setting the target value to a first distance that is relatively larger than a thickness of the sheet medium, in a period during which the sheet medium is not present between the first pressing unit and the second pressing unit; and setting the target value to a second distance, in a period during which the sheet medium and the image bearer are present between the first pressing unit and the second pressing unit, for application of a target pressure to the sheet medium via control of the driving unit based upon the second distance, wherein pressure applied to the sheet medium is controllable based upon control of the relative distance between the first pressing unit and the second pressing unit.

15. The method of claim 14, further comprising:

detecting an abnormality, upon the distance between the first pressing unit and the second pressing unit being relatively smaller than the first distance, and upon a leading end of the sheet medium entering between the first pressing unit and the second pressing unit.

16. The method of claim 15, wherein the detecting includes detecting the abnormality upon the distance between the first pressing unit and the second pressing unit deviating from a specified range including the second distance, and upon the sheet medium and the image bearer being present between the first pressing unit and the second pressing unit.

17. The method of claim 14, wherein the pressure is relatively increased as the second distance is relatively reduced.

* * * * *